US008333419B2

(12) United States Patent
Huang et al.

(10) Patent No.: US 8,333,419 B2
(45) Date of Patent: Dec. 18, 2012

(54) INNER TOP CORNER CONNECTOR OF CONTAINER BODY

(75) Inventors: Tianhua Huang, Qingdao (CN); Robert Wang, Qingdao (CN); Ryan Xu, Qingdao (CN); Jack Zhang, Qingdao (CN)

(73) Assignees: China International Marine Containers (Group) Ltd. (CN); Qingdao CIMC Reefer Trailer Co., Ltd. (CN); Qingdao CIMC Reefer Container Manufacture Co., Ltd. (CN); Qingdao CIMC Special Reefer Co., Ltd. (CN)

( * ) Notice: Subject to any disclaimer, the term of this patent is extended or adjusted under 35 U.S.C. 154(b) by 364 days.

(21) Appl. No.: 12/705,041

(22) Filed: Feb. 12, 2010

(65) Prior Publication Data

US 2010/0215425 A1 Aug. 26, 2010

(30) Foreign Application Priority Data

Feb. 20, 2009 (CN) ..... 2009 2 0009962 U

(51) Int. Cl.
*B60J 7/00* (2006.01)

(52) U.S. Cl. ..... 296/29; 296/182.1

(58) Field of Classification Search ..... 296/181.6, 296/185.1, 181.1, 181.3, 182.1, 186.1, 190.08, 296/29, 210; 105/404
See application file for complete search history.

(56) References Cited

U.S. PATENT DOCUMENTS

| | | | | |
|---|---|---|---|---|
| 3,827,137 | A * | 8/1974 | Schubach | 29/469 |
| 4,145,080 | A * | 3/1979 | Miller et al. | 296/24.35 |
| 6,802,521 | B1 * | 10/2004 | Boughton | 280/423.1 |
| 7,210,727 | B2 * | 5/2007 | Stephenson | 296/104 |
| 7,478,865 | B2 * | 1/2009 | Klein | 296/182.1 |

* cited by examiner

*Primary Examiner* — Joseph Pape
(74) *Attorney, Agent, or Firm* — Workman Nydegger

(57) ABSTRACT

An inner top corner connector for a container body includes an angled fitting of elastic material. An inner roof sheet connecting portion of the angled fitting has a first end portion bending toward the inner roof sheet and includes an outer seal blade inclining toward the inner roof sheet and the first end portion of the inner roof sheet connecting portion. An inner side panel connecting portion of the angled fitting is provided with a connecting plate for connecting to a top end portion of the inner side panel of the container body. The connecting plate is provided with a guide blade. An inserting groove is defined by the guide blade, the inner side panel connecting portion and a part of the connecting plate, wherein an angle of the angled fitting defined by the inner roof sheet connection portion and the inner side panel connecting portion is 95°-105°.

7 Claims, 2 Drawing Sheets

INNER TOP CORNER CONNECTOR OF CONTAINER BODY

CROSS REFERENCE TO RELATED APPLICATIONS

The present application claims a priority to Chinese patent application No. 200920009962.8 filed on Feb. 20, 2009, which is herein incorporated by reference in entirety thereof.

FIELD OF THE INVENTION

The present invention relates to an inner top corner connector for an inner roof sheet and an inner side panel of a thermal container body.

BACKGROUND OF THE INVENTION

A container body of a van, a van trailer or a freight container in refrigerated, thermal or dry cargo type consists of an inner plate, an outer plate, and a foaming heat preservation layer between the inner plate and the outer plate, in which the inner plate comprises an inner side panel, an inner roof sheet, and an aluminum floor. Since there is a large quantity of water vapor in the refrigerated container body, connections between adjacent components should have a good sealing property. In a usual case, the inner side panel is connected to the inner roof sheet via an angle aluminum which is drawn out through a profile and acts as a connector, the angle aluminum is connected to the inner side panel and the inner roof sheet respectively via blind rivets. However, since there is a gap at the rivets, and even a rivet mandrel has not good sealing property, it is easy for the water vapor in the container body to invade into the heat preservation layer via the gap at the rivets or the rivet mandrel, which reduces the heat preservation effect of the heat preservation layer. In addition, in this traditional connecting manner, the connector is connected to the inner side panel and the inner roof sheet in a mechanical and hard manner. Thereby, during uploading cargo into the container body or downloading cargo out of the container body, the angle aluminum may deform as a roof bow deforms, which would yield a repeated shearing action among the inner side panel, the inner roof sheet, the angle aluminum, and the rivets; with the time elapses, the angle aluminum would loose and the sealing property would further lower, and thus the water vapor in the container body would easily invade into the heat preservation layer and consequently further lower the heat preservation effect. Moreover, for connecting the inner side panel and the inner roof sheet via the angle aluminum, it is usual to install the angle aluminum inside the container body after a general assembly of the container body is finished, and it may require a special clamping tools to fix the angle aluminum and take a large quantity of labor to complete the installation of the rivets, causing waste of time and labor.

BRIEF SUMMARY OF THE INVENTION

An object of the present invention is to provide an inner top corner connector for a container body capable of improving heat preservation effect of the container body with respect to the above deficiencies in the prior art.

In order to attain the above object, the following technical solutions may be adopted according to the present invention.

According to the present invention, an inner top corner connector for a container body comprises an angled fitting made of elastic ABS or PVC material; an inner-roof-sheet-connecting portion of the angled fitting for connecting to an inner roof sheet of the container body has a first end portion bending toward the inner roof sheet, and is provided with an outer seal blade, which protrudes from an outer side of the inner-roof-sheet-connecting portion, and inclines toward the inner roof sheet and the first end portion of the inner-roof-sheet-connecting portion, near the first end portion of the inner-roof-sheet-connecting portion; an inner-side-panel-connecting portion of the angled fitting for connecting to an inner side panel of the container body has a second end portion bending toward the inner side panel, and is provided with a connecting plate for connecting to a top end portion of the inner side panel of the container body; the connecting plate is provided with a guide blade at a portion of the connecting plate and near the inner-side-panel-connecting portion; an inserting groove for receiving the top end portion of the inner side panel is defined by the guide blade, the inner-side-panel-connecting portion and a part of the connecting plate; wherein an angle of the angled fitting defined by the inner-roof-sheet-connecting portion and the inner-side-panel-connecting portion is 95°-105°.

The inner-roof-sheet-connecting portion of the angled fitting is provided with an inner seal blade, which protrudes from the outer side of the inner-roof-sheet-connecting portion, and inclines toward the inner roof sheet and away from the first end portion of the inner-roof-sheet-connecting portion, near an angled portion of the angled fitting.

The guide blade has a lower end portion bending away from the inner-side-panel-connecting portion.

The angle of the angled fitting is 100°.

The advantages and the positive effects according to the inner top corner connector of the container body of the present invention are as follows. In the inner top corner connector of the present invention, since the two seal faces of the inner top corner connector for connecting the inner roof sheet and the inner side panel do not have a right angle but an angle of 95°-105°, the inner top corner connector of elastic ABS or PVC material may have a very large compress amount when the roof sheet of the container body presses down. This may not only eliminate the dimension tolerance produced in the manufacturing process but also primarily enable the connector and the inner roof sheet to attain compressing seal, and consequently the container body has good sealing effect. Moreover, the sealing effect of the container body may be further improved due to the outer seal blade provided on the inner-roof-sheet-connecting portion of the connector and the inserting groove provided at the inner side panel connection portion for receiving the inner side panel. A pressure between the connector and the inner roof sheet may achieve an optimum state through an inner top corner connector which has an appropriate strength produced from a setting hardness of ABS or PVC material with calculation. During the application of the present invention, since rivets are installed only at the inner-side-panel-connecting portion of the container body, the number of rivets used is relatively small, and no leakage-out occurs, which may effectively prevent water vapor in the container body from invading into the heat preservation layer via a rivet hole and the mandrel portion of the blind rivet and thus maintain good heat preservation property of the container body. In addition, the connection between the inner top corner connector and the inner side panel and the inner roof sheet is not of a mechanical type, but an elastic type. When the container body is subject to a force and thereby bends, the connector may have large displacement with respect to the inner roof sheet and the inner side panel by means of the characteristics itself, and the connector may restore into an original seal state after the deformation restores. That is to say, the inner top corner connector of the present invention has large degree of freedom and may restore after deformation, and thus good sealing property may be assured for a long time. The heat preservation property of the container body is directly determined by the sealing property, and thus a container body may have good heat preservation property with using the inner top corner connector of the present invention.

The above and other objects, features and advantages will be more apparent by way of the following description of preferred embodiments with reference to the drawings.

DETAILED DESCRIPTION OF THE INVENTION

Hereinafter, embodiments of the present invention will be described in details. It should be noted that the embodiments as set forth herein is only used for illustration, but not limiting the present invention.

Figure 2:
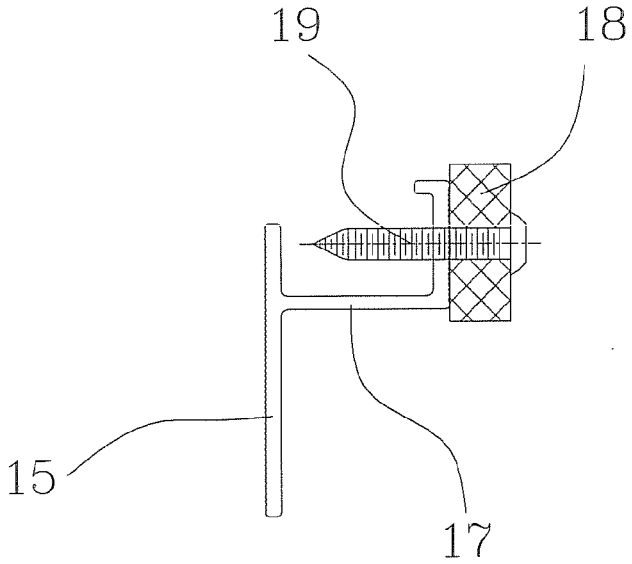
FIG. 2 is a structural diagram illustrating that an inner roof sheet and an inner side panel of a container body are connected through the inner top corner connector of the container body according to the present invention.
Figure 3:
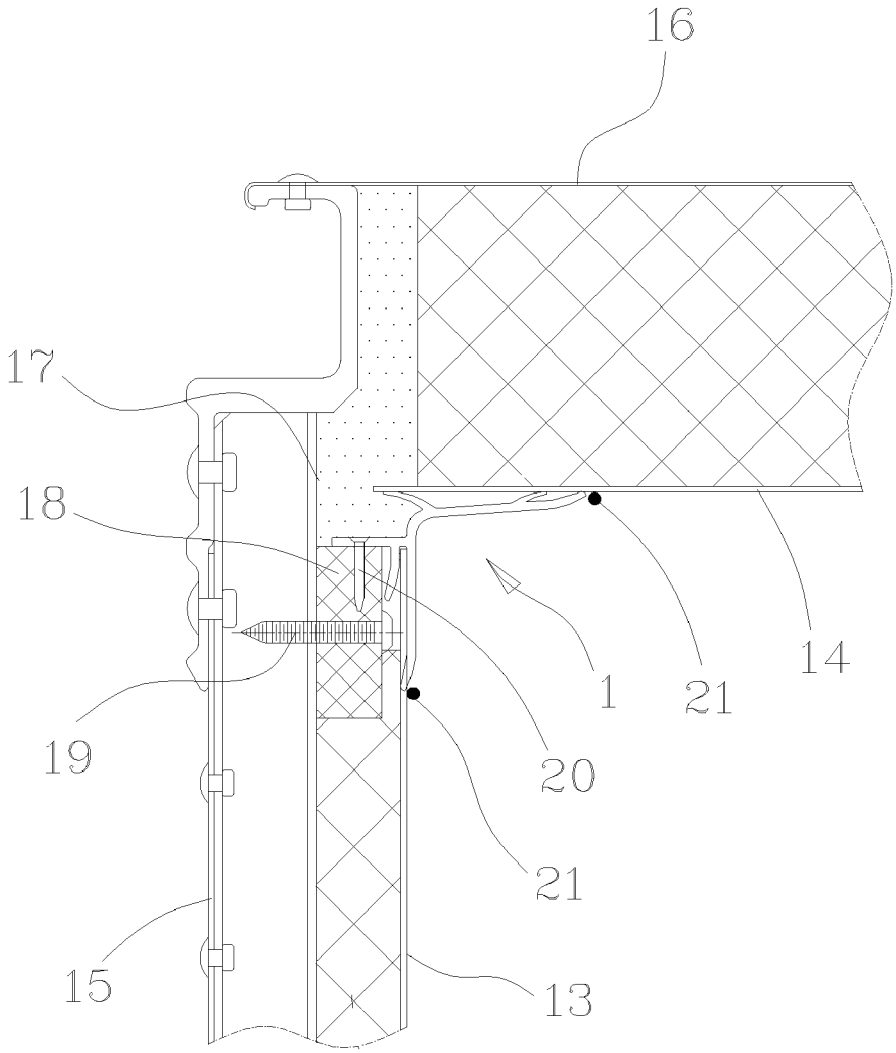
FIG. 3 is a diagram illustrating that a strengthening wood mass in the side panel of the container body is fixed on a strengthening rib of the side panel of the container body via a tapping screw.

As shown in FIG. 2 and FIG. 3, a container body of a van, a van trailer and a freight container in refrigerated, thermal or dry cargo type consists of an inner plate, an outer plate, and a foaming heat preservation layer between the inner plate and the outer plate. The inner plate comprises an inner side panel 13, an inner roof sheet 14, and an aluminum floor (not illustrated in the figures). The outer plate comprises an outer side panel 15, an outer roof sheet 16 and so on. A strengthening rib 17 with an L-shape cross section is connected onto the outer side panel 15.

Figure 1:
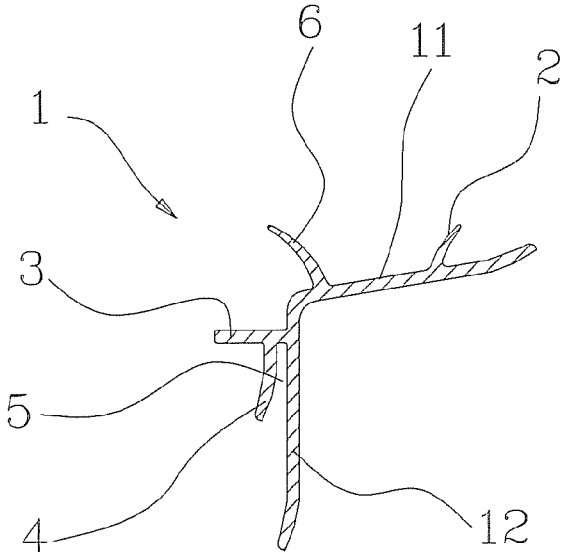
FIG. 1 is a structural diagram of an inner top corner connector for a container body according to the present invention.

As shown in FIG. 1, an inner top corner connector according to the present invention comprises an angled fitting 1 made of elastic ABS material or engineering plastic material. The angled fitting 1 may be also made of other elastic material, such as PVC, etc. One part of the angled fitting 1 is an inner-roof-sheet-connecting portion 11 for connecting to the inner roof sheet 14, and the other part of the angled fitting 1 is an inner-side-panel-connecting portion 12 for connecting to an inner side panel 13. An angle between these two portions is 100°, but not limited to 100°. The angle is feasible within a range of 95°-105°. The inner-roof-sheet-connecting portion 11 of the angled fitting 1 has a first end portion bending toward the inner roof sheet. The inner-roof-sheet-connecting portion 11 is provided with an outer seal blade 2, which protrudes from an outer side (i.e. a side directing toward the inner roof sheet during installation) of the inner-roof-sheet-connecting portion 11, and inclines toward the inner roof sheet 14 and the first end portion of the inner-roof-sheet-connecting portion 11, near the first end portion of the inner-roof-sheet-connecting portion 11. The outer seal blade 2 may function as good sealing so as to prevent water vapor in the container body from permeating into the foaming heat preservation layer of the inner roof sheet 14. The inner-roof-sheet-connecting portion 11 of the angled fitting 1 is provided with an inner seal blade 6, which protrudes from the outer side of the inner-roof-sheet-connecting portion 11, and inclines toward the inner roof sheet 14 and away from the first end portion of the inner-roof-sheet-connecting portion 11, near an angled portion of the angled fitting. A function of the inner seal blade 6 is to obstruct the foaming material in the foaming heat preservation layer from overflowing and prevent foam from leaking. The inner-side-panel-connecting portion 12 of the angled fitting 1 has a second end portion bending toward the inner side panel 13. The inner-side-panel-connecting portion 12 is provided with a connecting plate 3, which is horizontal and integral with the inner-side-panel-connecting portion 12, on a side directing toward the inner side panel 13. The connecting plate 3 is for connecting to a top end portion of the inner side panel 21 of the container body. The connecting plate 3 is provided with a guide blade 4, which is almost in parallel with the inner-side-panel-connecting portion 12, at a portion of the connecting plate 3 near the inner-side-panel-connecting portion 12. An inserting groove 5 for receiving the top end portion of the inner side panel 13 is defined by the guide blade 4, the inner-side-panel-connecting portion 12 and a part of the connecting plate 3. The guide blade 4 has a lower end portion bending away from the inner-side-panel-connecting portion 12 4; the guide blade 4 with such a lower end portion may allow the inner side panel 13 to be easily inserted into the inserting groove 5. The first end portion of the inner-roof-sheet-connecting portion 11 and the second end portion of the inner-side-panel-connecting portion 12 may make two ends of the inner top corner connector of the container body of the present invention sufficiently contact with the inner roof sheet 14 and the inner side panel 13, which is beneficial to improve the sealing property of the container body.

As shown in FIG. 2 and FIG. 3, the connection of the inner roof sheet 14 and the inner side panel 13 of the container body through the inner top corner connector of the container body of the present invention is achieved through the following steps: fixing strengthening wood mass 18 on side panel strengthening ribs 17 through tapping screws 19 in advance, so that each strengthening rib 17 is fixed with a piece of the strengthening wood mass 18; beginning to install the inner top corner connector of the present invention just after the foaming material in the heat preservation layer of the side panel has foamed; applying a sealant inside the inserting groove 5 of the inner top corner connector and inserting the inserting groove 5 onto the top end of the inner side panel 13; adjusting the orientation of the inner top corner connector, and fixing the connecting plate 3 onto respective strengthening wood mass 18 via a number of steel nails 20; during the general assembly, slowly lowering the inner roof sheet 14, observing the situation of the inner top corner connector when the inner roof sheet 14 contacts with the inner top corner connector, at the same time lightly knocking the inner top corner connector so as to assure that the inner top corner connector sufficiently contacts with the inner roof sheet 14 and completely seals; after fixing the inner roof sheet 14 and completing secondary foaming, applying a sealant 21 respectively at end portions where the inner top corner connector respectively contacts with the inner side panel 13 and the inner roof sheet 14. In the present invention, there exists a dual-sealing between a vertical side of the inner top corner connector and the inner side panel 13, in which one sealing is from the sealant 21 and the other sealing is from the inserting groove 5 and the sealant inside the inserting groove 5; there exists a tri-sealing between the inner-roof-sheet-connecting portion 11 of the inner top corner connector and the inner roof sheet 14, in which the first sealing is from a sealant 21, the second sealing is from the outer seal blade 2, and the third sealing is from the inner seal blade 6. Therefore, the container body has good sealing property with the inner top corner connector of the present invention.

The inner-side-panel-connecting portion 12 of the inner top corner connector of the present invention is fixedly connected to the inner side panel 13 via the steel nails 20, and self-press of the inner-roof-sheet-connecting portion 11 completely depends on the shape and material property of the inner top corner connector and the weight of the inner roof sheet 14, which requires very low precision control during installation and is convenient to install. The two sealing faces of the inner top corner connector does not have a right angle, but 95°-105°, and thus when the roof sheet is pressed down, the inner top corner connector of elastic ABS material may have a very large compression amount. This may not only eliminate the dimension tolerance produced in the manufacturing process but also enables the inner top corner connector and the inner roof sheet 14 to realize a compressing seal. Since the inner top corner connector is made of the elastic ABS material, the hardness of the ABS material may be adjusted during manufacture of the inner top corner connector, so as to make a pressure between the inner top corner connector and the inner roof sheet 14 reach an optimum state.

After the inner top corner connector of the present invention is connected to the inner side panel 13 and the inner roof sheet 14, no rivet is exposed on the whole external surface. At the same time, the inner top corner connector of the present invention may be arbitrarily matched with the color of an inner wall of the container body, so as to attain an effect that the inner top corner connector may be integral with the inner wall of the container and consequently has a good appearance.

Due to the inner top corner connector of the present invention, the number of fasteners may be reduced by half, and no special device and special clamping tools are required, so the process is simple, convenient and quick. At the same time, installation limitation is relative loose; cost, labor and time are effectively saved, the efficiency is improved. It may be convenient to install and use the inner top corner connector of the present invention in factory or other places.

The present invention is suitable to the connection between the inner roof sheet and the inner side panel of the container body of a van, a van trailer or a semi-trailer carrier in refrigerated, thermal or dry cargo type, or a refrigerated, or thermal freight container.

Although the present invention has been described with reference to the several typical embodiments, it should be understood that the terminology used herein is descriptive and illustrative, but not limitative. Since the present invention may be embodied in various forms without departing from the spirit or essentiality of the present invention, it should be understood that the above embodiments are not limited to any previous details and should be widely interpreted within the range of the spirit and the scope defined by the attached claims of the present invention, therefore all changes and variants falling within the claims and the equivalent scope thereof would be covered by the attached claims.

What is claimed is:

1. An inner top corner connector for a container body, comprising:

an angled fitting made of elastic ABS or PVC material, comprising:

an inner roof sheet connecting portion for connecting to an inner roof sheet of the container body, the inner roof sheet connecting portion having a first end portion bending toward the inner roof sheet;

an outer seal blade provided near the first end portion of the inner roof sheet connecting portion protruding from an outer side of the inner roof sheet connecting portion, and inclining toward the inner roof sheet and the first end portion of the inner roof sheet connecting portion;

an inner side panel connecting portion for connecting to an inner side panel of the container body, the inner side panel connecting portion having a second end portion bending toward the inner side panel;

a connecting plate for connecting to a top end portion of the inner side panel of the container body, the connecting plate provided on the inner side panel connecting portion;

a guide blade provided at a portion of the connecting plate and near the inner side panel connecting portion; and an inserting groove for receiving the top end portion of the inner side panel, the inserting groove defined by the guide blade, the inner side panel connecting portion and a part of the connecting plate, wherein an angle of the angled fitting defined by the inner roof sheet connecting portion and the inner side panel connection portion is 95° to 105°.

2. The inner top corner connector for the container body according to claim 1, further comprising:

an inner seal blade provided near an angled portion of the angled fitting protruding from the outer side of the inner roof sheet connecting portion, and inclining toward the inner roof sheet and away from the first end portion of the inner roof sheet connecting portion.

3. The inner top corner connector for the container body according to claim 1, wherein the guide blade has a lower end portion bending away from the inner side panel connecting portion.

4. The inner top corner connector for the container body according to claim 2, wherein the guide blade has a lower end portion bending away from the inner side panel connecting portion.

5. The inner top corner connector for the container body according to claim 3, wherein the angle of the angled fitting is 100°.

6. The inner top corner connector for the container body according to claim 4, wherein the angle of the angled fitting is 100°.

7. A container body, comprising:

an inner roof sheet;

an inner side panel; and an inner top corner connector, comprising:

an angled fitting made of elastic ABS or PVC material, comprising:

an inner roof sheet connecting portion for connecting to the inner roof sheet, the inner roof sheet connecting portion having a first end portion bending toward the inner roof sheet;

an outer seal blade provided near the first end portion of the inner roof sheet connecting portion, the outer seal blade protruding from an outer side of the inner roof sheet connecting portion and inclining toward the inner roof sheet and the first end portion of the inner roof sheet connecting portion;

an inner side panel connecting portion for connecting to the inner side panel, the inner side panel connecting portion having a second end portion bending toward the inner side panel;

a connecting plate for connecting to a top end portion of the inner side panel, the connecting plate provided on the inner side panel connecting portion;

a guide blade provided at a portion of the connecting plate and near the inner side panel connecting portion; and an inserting groove for receiving the top end portion of the inner side panel, the inserting groove defined by the guide blade, the inner side panel connecting portion and a part of the connecting plate, wherein an angle of the angled fitting defined by the inner roof sheet connecting portion and the inner side panel connection portion is 95° to 105°.

* * * * *